US011572739B2

(12) United States Patent
Pray

(10) Patent No.: US 11,572,739 B2
(45) Date of Patent: Feb. 7, 2023

(54) RFID ACTUATED RELEASE OF MILL FROM WHIPSTOCK

(71) Applicant: WEATHERFORD TECHNOLOGY HOLDINGS, LLC, Houston, TX (US)

(72) Inventor: Jeffery Scott Pray, Shenandoah, TX (US)

(73) Assignee: Weatherford Technology Holdings LLC, Houston, TX (US)

( * ) Notice: Subject to any disclaimer, the term of this patent is extended or adjusted under 35 U.S.C. 154(b) by 3 days.

(21) Appl. No.: 17/184,628

(22) Filed: Feb. 25, 2021

(65) Prior Publication Data

US 2022/0268101 A1 Aug. 25, 2022

(51) Int. Cl.
*E21B 7/06* (2006.01)
*E21B 47/13* (2012.01)

(52) U.S. Cl.
CPC ..... *E21B 7/061* (2013.01); *E21B 47/13* (2020.05)

(58) Field of Classification Search
CPC ..... E21B 7/061; E21B 47/13; E21B 7/06
See application file for complete search history.

(56) References Cited

U.S. PATENT DOCUMENTS

| | | | |
|---|---|---|---|
| 2,207,920 | A | 7/1940 | Hughes |
| 3,339,636 | A | 9/1967 | Frisby |
| 5,887,655 | A | 3/1999 | Haugen et al. |
| 7,878,253 | B2 | 2/2011 | Stowe et al. |
| 8,141,634 | B2 | 3/2012 | Fisher et al. |
| 8,833,442 | B2 | 9/2014 | Ibragimov et al. |
| 9,004,159 | B2 | 4/2015 | Alsup et al. |
| 10,704,328 | B2 | 7/2020 | Korf et al. |
| 2010/0012322 | A1 | 1/2010 | McGarian |
| 2010/0224372 | A1 | 9/2010 | Stowe et al. |
| 2012/0261193 | A1 | 10/2012 | Swadi et al. |
| 2013/0319653 | A1 | 12/2013 | Ibragimov et al. |
| 2014/0360723 | A1 | 12/2014 | Utter et al. |

(Continued)

FOREIGN PATENT DOCUMENTS

| | | | |
|---|---|---|---|
| EP | 0948700 | B1 | 1/2006 |
| WO | 2009/137537 | A2 | 11/2009 |
| WO | 2020/002936 | A1 | 1/2020 |

OTHER PUBLICATIONS

International Search Report with Written Opinion dated Mar. 15, 2022 for PCT Patent Application No. PCT/US2022/013201, 13 pages.

(Continued)

*Primary Examiner* — Taras P Bemko
(74) *Attorney, Agent, or Firm* — Smith IP Services P.C.

(57) ABSTRACT

A bottom hole assembly for use in a subterranean well can include a whipstock, a mill releasably secured to the whipstock, an antenna, and a release mechanism configured to release the mill from the whipstock in response to a predetermined radio frequency signal received by the antenna. A method can include positioning a bottom hole assembly in a well, the bottom hole assembly including a mill and a whipstock releasably secured to the mill, and then releasing the mill from the whipstock by displacing a radio frequency identification tag into the bottom hole assembly. A well system can include a bottom hole assembly comprising an anchor, a whipstock and a mill, and a radio frequency identification tag displaceable with fluid flow into the bottom hole assembly.

21 Claims, 10 Drawing Sheets

(56) References Cited

U.S. PATENT DOCUMENTS

| | | | | |
|---|---|---|---|---|
| 2015/0211318 | A1* | 7/2015 | Redlinger | E21B 31/12 166/66.4 |
| 2016/0238055 | A1 | 8/2016 | Donovan | |
| 2018/0209233 | A1* | 7/2018 | Hulsewe | E21B 29/06 |
| 2018/0225485 | A1 | 8/2018 | Ownby et al. | |
| 2019/0003264 | A1 | 1/2019 | Swadi et al. | |
| 2019/0106940 | A1 | 4/2019 | Korf et al. | |
| 2020/0131886 | A1 | 4/2020 | Hora et al. | |
| 2020/0190908 | A1 | 6/2020 | Pray et al. | |
| 2021/0372219 | A1 | 12/2021 | Brown-Kerr et al. | |

OTHER PUBLICATIONS

Techmaster Oil Tools Inc.; "MasterWhipstock", company brochure via www.TMOT.ca, dated 2019, 21 pages.

Weatherford; "QuickCut Casing Exit System RHS-Type Anchor", company brochure 2697.03, dated 2006-2012, 4 pages.

Weatherford; "Shallow-Angle QuickCut Casing Exit System RHS-Type Anchor", company brochure 2702.02, dated 2008-2011, 4 pages.

Weatherford; "Shallow-Angle QuickCut Casing Exit System RMN-Type Anchor or RHN-Type Anchor", company brochure 2700.01, dated 2008, 4 pages.

Wellbore Integrity Solutions; "Trackmaster Select", company brochure 16-BDT-131810 | WIS-BR-MKT-010_rev2 via www.wellboreintegrity.com, dated 2019, 9 pages.

Weatherford; "RFID-Enabled Tools", company brochure 12650.01, dated 2018, 12 pages.

Weatherford; "RFID OptiROSS Remotely Operated Sliding Sleeve", company brochure 12907.01, dated 2018, 2 pages.

International Search Report with Written Opinion dated Jan. 31, 2022 for PCT Patent Application No. PCT/US2021/054634, 12 pages.

Office Action dated May 25, 2022 for U.S. Appl. No. 17/103,838, 25 pages.

* cited by examiner

RFID ACTUATED RELEASE OF MILL FROM WHIPSTOCK

BACKGROUND

This disclosure relates generally to equipment utilized and operations performed in conjunction with a subterranean well and, in an example described below, more particularly provides for RFID actuated release of a mill from a whipstock.

A whipstock is sometimes used in well drilling operations to form a lateral or branch wellbore from a main or parent wellbore. If the main or parent wellbore is lined with casing, a window may be formed through the casing by use of the whipstock with a mill specifically designed for this purpose.

Typically, the whipstock is releasably attached to the mill during conveyance of this equipment into the well. When the whipstock is at a desired position, an anchor is set and the mill is released from the whipstock.

A shearable bolt is typically used to releasably secure the whipstock to the mill. However, the bolt may be inadvertently or prematurely sheared, for example, if an obstruction is encountered during the conveyance of the equipment into the well, substantial changes in wellbore direction are encountered, etc.

Therefore, it will be readily appreciated that improvements are continually needed in the art of designing, constructing and operating mechanisms for releasing mills from whipstocks in wells. Such improvements may be useful in a variety of different drilling operations, such as, forming casing exit windows, drilling lateral or branch wellbores, sidetracking, etc.

DETAILED DESCRIPTION

Figure 1:
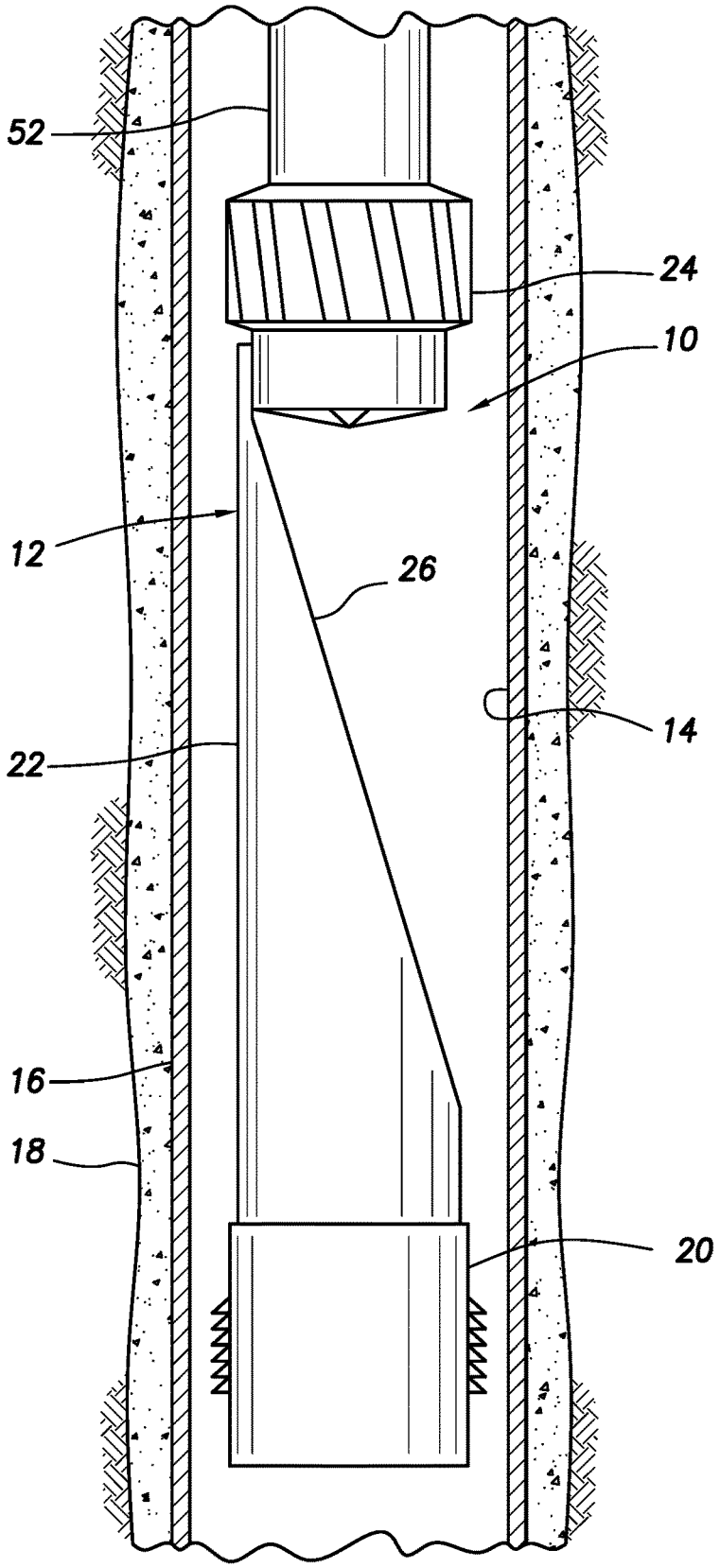
FIG. 1 is a representative partially cross-sectional view of an example of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a bottom hole assembly 12 is being conveyed into a wellbore 14 that is lined with casing 16 and cement 18. It is desired, in this example, to drill another wellbore (such as, a branch or lateral wellbore) intersecting the wellbore 14.

The bottom hole assembly 12 includes an anchor 20, a whipstock 22 and a mill 24. Additional or different components (such as, a casing annular section locator, an orienting device, etc.) may be used in other examples. The scope of this disclosure is not limited to the use of any particular components or combination of components in a bottom hole assembly.

The anchor 20 is used to secure the whipstock 22 at a desired position in the wellbore 14 for forming an exit window through the casing 16. The anchor 20 may be set in the wellbore 14 using a variety of different techniques, such as, by applying hydraulic pressure to a setting mechanism of the anchor, by mechanical manipulation of the anchor (for example, raising, rotating, lowering, etc.), or by inflating an elastomeric element of the anchor.

In some examples, the anchor 20 may include slips for gripping an inner surface of the casing 16, or keys that engage one or more corresponding profiles formed in the casing. The anchor 20 could be a packer, or an anchoring device without an annular seal element for sealing against the casing 16. The scope of this disclosure is not limited to use of any particular type of anchor in a bottom hole assembly, or to any particular technique for securing the anchor in a wellbore.

The whipstock 22 is used to laterally deflect the mill 24. For this purpose, the whipstock 22 includes an inclined surface 26 formed thereon. When the mill 24 is displaced downhole relative to the whipstock 22 after the anchor 20 is set, the inclined surface 26 will deflect the mill laterally, thereby causing the mill to cut an opening or window through the casing 16.

In the example depicted in FIG. 1, the mill 24 is of the type known to those skilled in the art as a lead or pilot mill specially configured to initiate the cutting of the window through the casing 16. A drill string 52 connected above the mill 24 can include other types of mills and other cutting devices, such as, watermelon mills, finishing mills, etc. The scope of this disclosure is not limited to use of any particular type or combination of mills or other cutting devices in a drill string.

The mill 24 in this example is also specially configured for releasable attachment to the whipstock 22, as described more fully below. It is desirable for the anchor 20, the whipstock 22 and the mill 24 to be conveyed into the wellbore 14 in a single trip into the well, for convenience, efficiency and reduced expense. Thus, after the whipstock 22 has been appropriately positioned in the wellbore 14 and the anchor 20 has been set, the mill 24 is released from the whipstock and is displaced downhole while rotating, in order to begin cutting through the casing 16.

Figure 2:
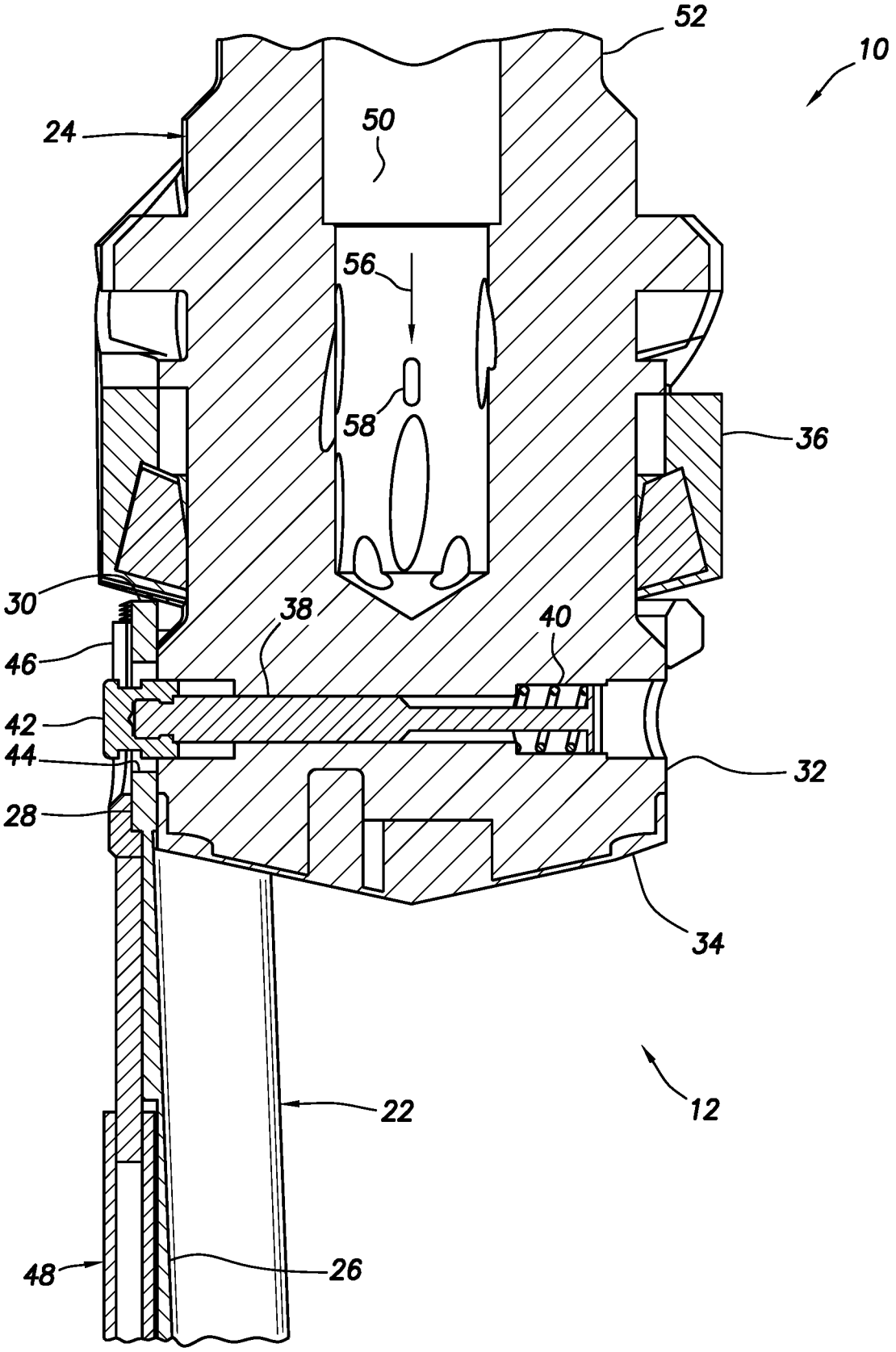
FIG. 2 is a representative cross-sectional view of an example of a hydraulic release mechanism that releasably secures a mill to a whipstock.

Referring additionally now to FIG. 2, a more detailed cross-sectional view of an example of the releasable attachment between the mill 24 and the whipstock 22 is representatively illustrated. In this example, a collar or annular section 28 near an upper end 30 of the whipstock 22 encircles the mill 24 and is releasably secured to an outer diameter 32 of the mill positioned longitudinally between cutting structures 34, 36 on the mill.

As depicted in FIG. 2, a retractable pin 38 is laterally slidingly received in the mill 24. The pin 38 is biased rightward (as viewed in FIG. 2) by a spring 40 or another biasing device. The pin 38 has a grooved head 42 that is received in an opening 44 formed through the annular section 28 of the whipstock 22.

A latch member 46 of a hydraulic release mechanism 48 initially retains the head 42 in the opening 44, thereby preventing the pin 38 from fully retracting into the mill 24. The latch member 46 is configured to engage the grooved head 42 and thereby prevent retraction of the pin 38 when the latch member is in an upper position as depicted in FIG. 2.

However, when the hydraulic release mechanism 48 is actuated to displace the latch member 46 downward and out of engagement with the grooved head 42, the spring 40 will then be able to displace the pin 38 to the right (as viewed in FIG. 2). This will withdraw the head 42 from the opening 44, and will thereby permit the mill 24 to be displaced downhole relative to the whipstock 22.

Suitable hydraulic release mechanisms are described in U.S. Pat. No. 10,704,328 and US publication no. 2020/0190908, the entire disclosures of which are incorporated herein by this reference in their entireties for all purposes. A hydraulic release mechanism described in the U.S. Pat. No. 10,704,328 and US publication no. 2020/0190908 is actuated by flowing fluid 56 through an internal flow passage 50 extending through the drill string 52. When a flow rate of the fluid 56 is increased to a predetermined level, hydraulic pressure is applied to one or more pistons of the hydraulic release mechanism 48, thereby causing the latch member 46 to be displaced downward and out of engagement with the head 42.

In the FIGS. 1 & 2 system 10, however, hydraulic pressure is not applied to the pistons of the hydraulic release mechanism 48 in response to a predetermined flow rate of the fluid 56 being achieved. Instead, increased pressure is applied to the pistons of the hydraulic release mechanism 48 in response to a radio frequency identification (RFID) tag 58 being displaced with the fluid 56 through (or at least into) the bottom hole assembly 12. In some examples described below, the RFID tag 58 may be displaced through the flow passage 50, and then through the mill 24 and into the wellbore 14.

Figure 3:
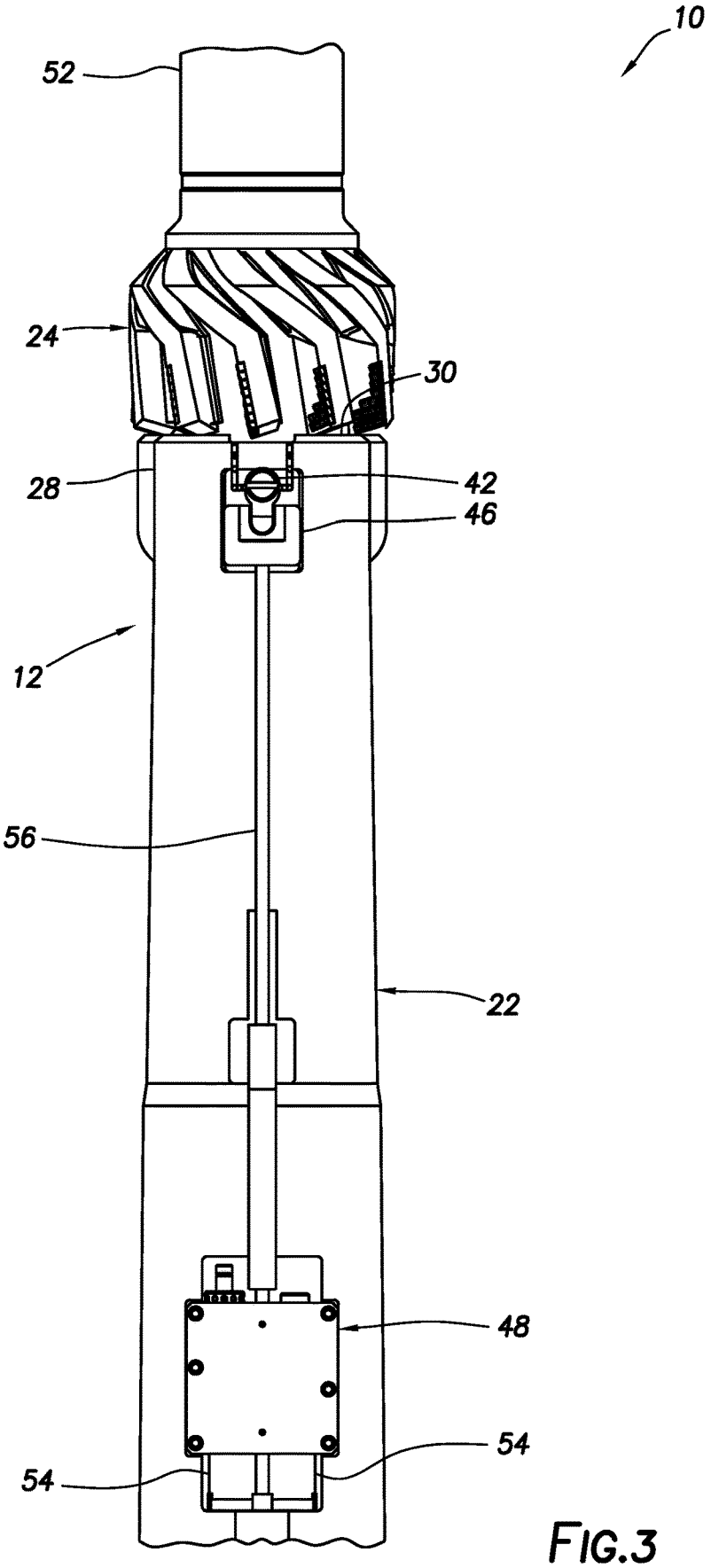
FIG. 3 is a representative side view of the hydraulic release mechanism in a release configuration.

Referring additionally now to FIG. 3, a side view of the mill 24 and the whipstock 22 is representatively illustrated. In this view, the hydraulic release mechanism 48 has been actuated in response to the RFID tag 58 being displaced with the fluid 56 through the flow passage 50.

Pistons 54 of the hydraulic release mechanism 48 have displaced downward due to increased hydraulic pressure applied to the pistons. The pistons 54 are connected to the latch member 46 via a rod, cable or other linkage 56. Thus, the latch member 46 is displaced downward out of engagement with the head 42 of the pin 38 in response to the increased hydraulic pressure applied to the pistons 54 of the hydraulic release mechanism 48.

Figure 4:
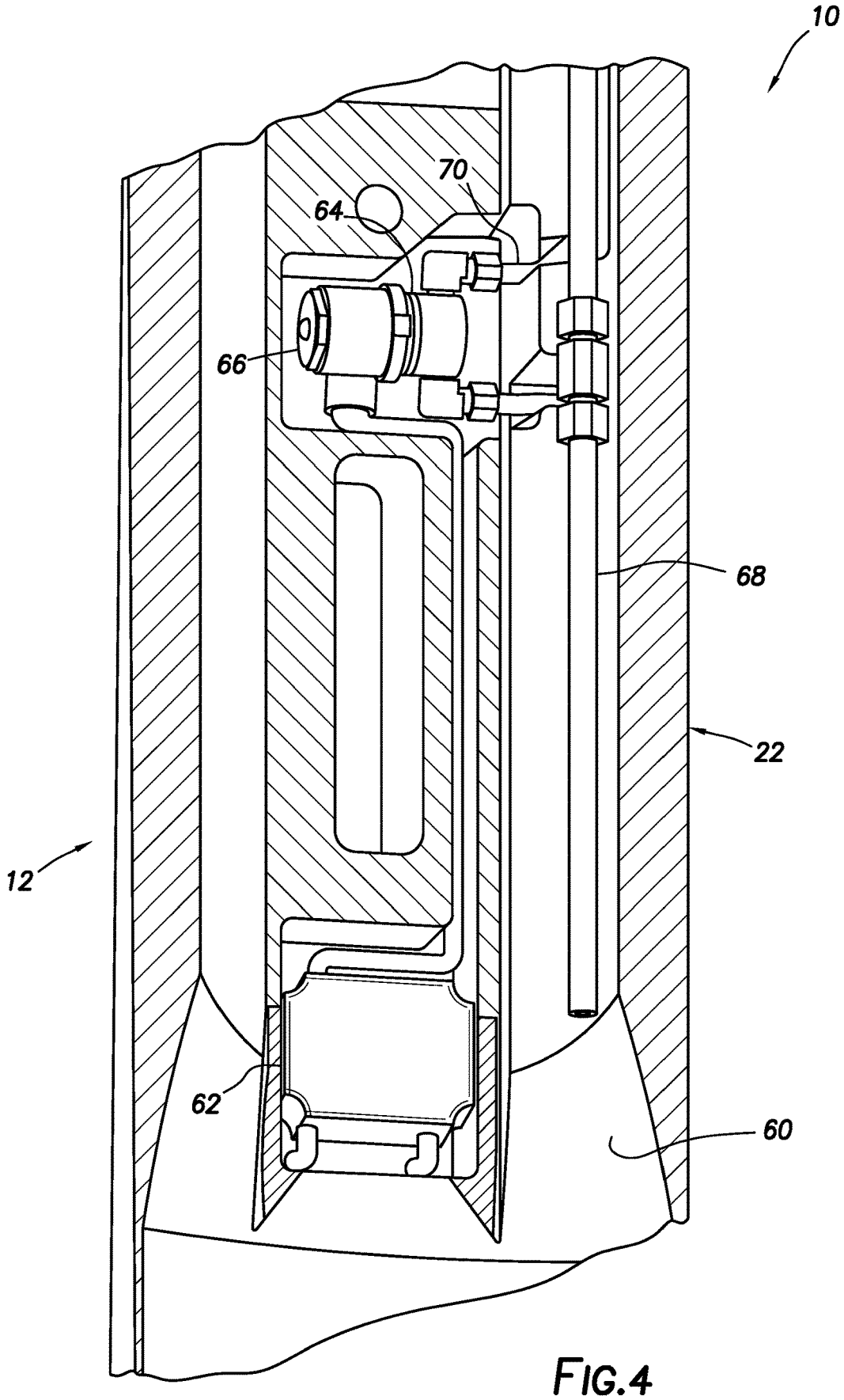
FIG. 4 is a representative side view of an example of an RFID controller and valve for the hydraulic release mechanism.

Referring additionally now to FIG. 4, a recessed area 60 in a lower portion of the whipstock 22 is representatively illustrated. In this view it may be seen that an RFID controller 62 and a valve 64 are positioned in the recessed area 60. An actuator 66 for the valve 64 is electrically connected to the RFID controller 62.

Tubing 68 extends longitudinally through the recessed area 60. The tubing 68 provides fluid communication between the flow passage 50 (see FIG. 2) and the anchor 20. In this example, the flow of the fluid 56 through a restriction in the flow passage 50 causes an increase in pressure in the flow passage, and this increased pressure is communicated via the tubing 68 to the anchor 20, in order to set the anchor.

After the anchor 20 is set, thereby securing the bottom hole assembly 12 in the wellbore 14, the RFID tag 58 is released into the drill string 52 with the flow of the fluid 56. The RFID tag 58 is conveyed into and through the bottom hole assembly 12 with the fluid 56 flow.

An antenna connected to the RFID controller 62 receives a predetermined radio frequency signal from the RFID tag 58. In response, the controller 62 causes the actuator 66 to operate the valve 64, which is initially closed. When the valve 64 is opened, fluid pressure in the tubing 68 is communicated via a flow path 70 to the pistons 54 of the release mechanism 48, thereby allowing the pin 38 to retract as described above and releasing the mill 24 from the whipstock 22.

In other examples, the release mechanism 48 may not operate hydraulically. For example, the release mechanism 48 could operate electrically. The RFID controller 62 could be connected to an electrical solenoid that displaces the latch member 46 in response to the RFID tag 58 being displaced into the bottom hole assembly 12. Thus, the scope of this disclosure is not limited to hydraulic actuation of the release mechanism 48, or to any other specific details of the bottom hole assembly 12 as described herein or depicted in the drawings.

Figure 5:
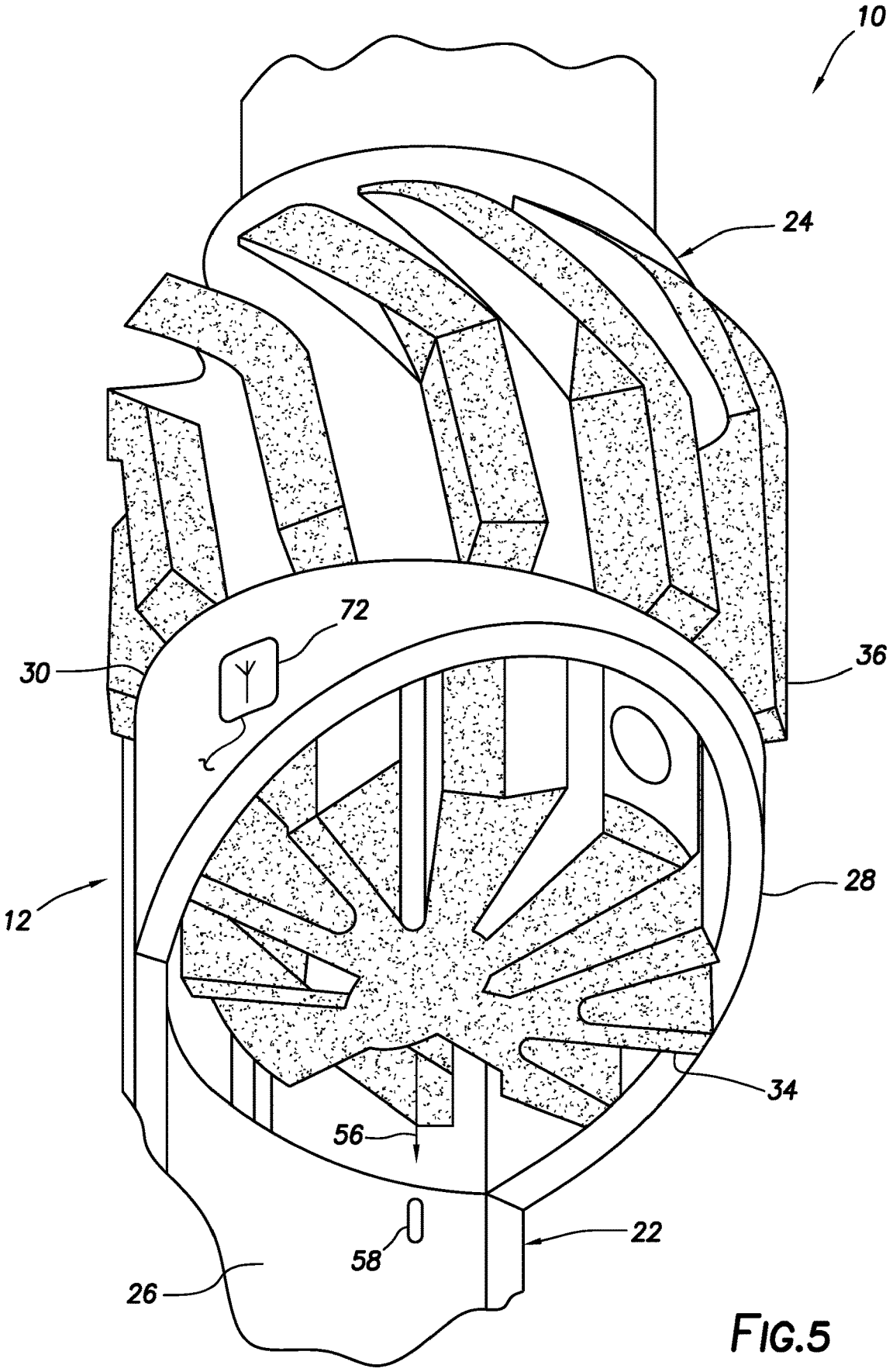
FIG. 5 is a representative perspective view of an example of an RFID antenna in an annular section of the whipstock.

Referring additionally now to FIG. 5, another view of the releasable attachment between the whipstock 22 and the mill 24 is representatively illustrated. In this view, one manner in which an antenna 72 may be incorporated into the whipstock 22 is depicted.

In the FIG. 5 example, the antenna 72 is positioned in the annular section 28 at the upper end 30 of the whipstock 22. In this position, the antenna 72 is capable of interrogating and receiving the radio frequency signal from the RFID tag 58 as it is displaced with the fluid 56 through the mill 24.

The antenna 72 is electrically connected to the RFID controller 62. The antenna 72 enables the RFID controller 62 to detect when the RFID tag 58 has been displaced into (and through in this example) the bottom hole assembly 12. When the RFID controller 62 detects the predetermined radio frequency signal, the controller causes the valve 64 to be actuated as described above, thereby releasing the mill 24 from the whipstock 22.

Figure 6:
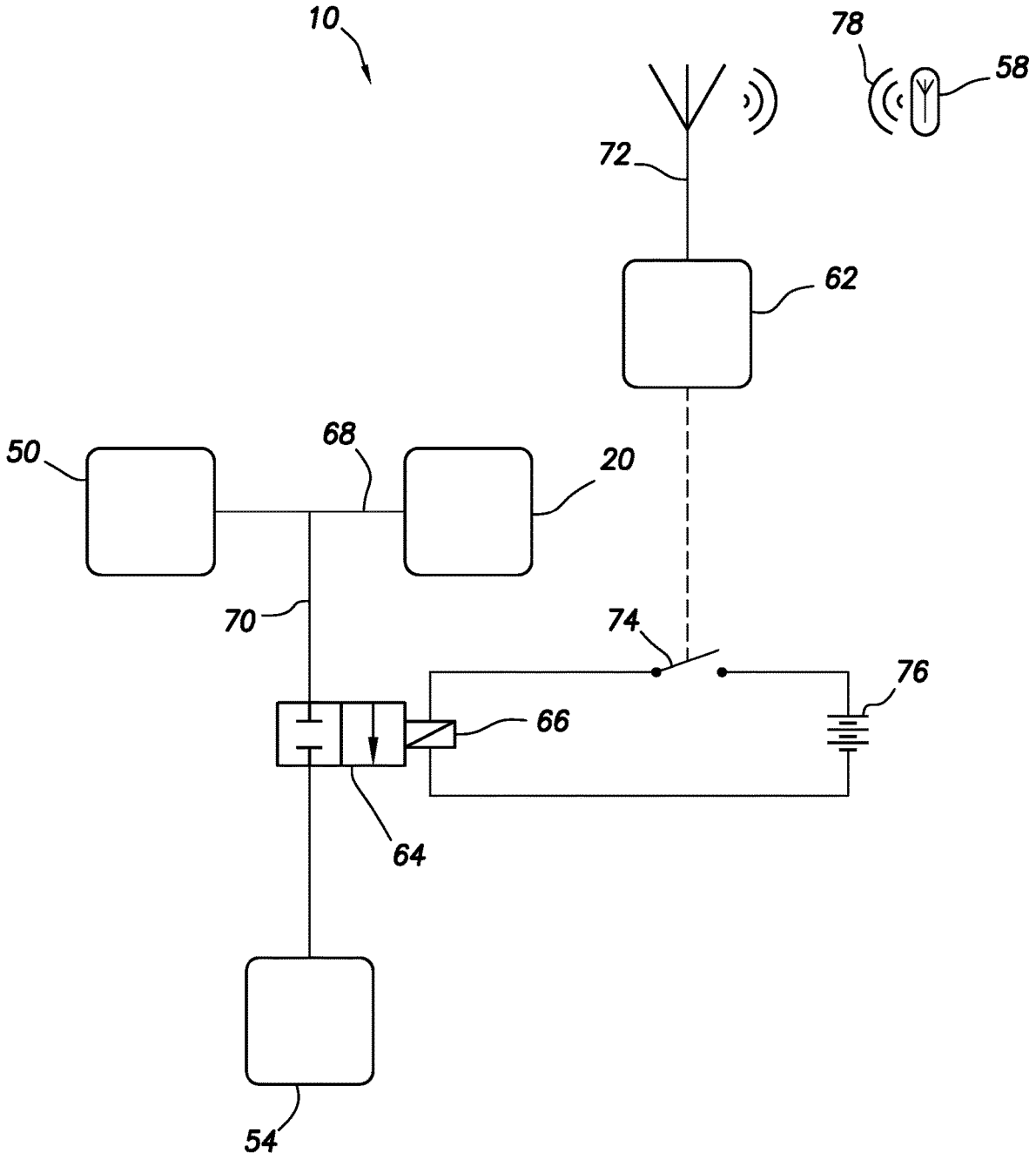
FIG. 6 is a representative schematic of an example of an RFID actuated hydraulic release mechanism.

Referring additionally now to FIG. 6, a schematic of an example of the RFID actuated system 10 is representatively illustrated. In this schematic, the manner in which the controller 62 can control operation of the valve 64 can be seen.

In this example, the actuator 66 comprises an electrical solenoid connected between a switch 74 and a battery 76. Operation of the switch 74 is controlled by the RFID controller 62. The switch 74 and the battery 76 may be positioned in the whipstock 22 (for example, in the recessed area 60, see FIG. 4) or in another component of the system 10. In some examples, at least the switch 74 may be an integral component of the RFID controller 62. Thus, the scope of this disclosure is not limited to any particular elements, combination of elements or arrangement of elements as depicted in FIG. 6 or described herein.

In the FIG. 6 example, the antenna 72 receives the predetermined radio frequency signal 78 from the RFID tag 58. In response, the controller 62 closes the switch 74. Electrical power is thereby applied from the battery 76 to the actuator 66.

When the actuator 66 is supplied with the electrical power from the battery 76, the valve 64 is operated to its open configuration, thereby opening the flow path 70. Increased hydraulic pressure (due to the flow of the fluid 56) is then communicated from the flow passage 50 to the pistons 54 of the release mechanism 48 via the tubing 68 and the flow path 70.

Figure 7:
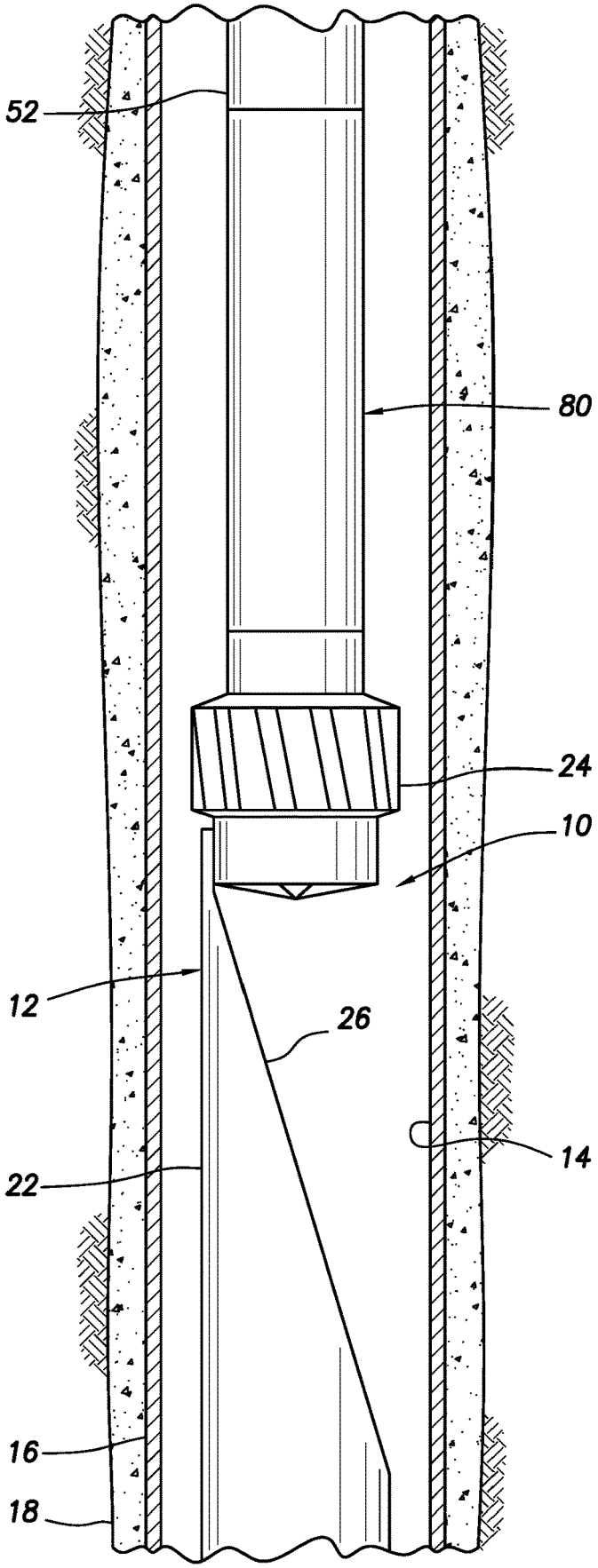
FIG. 7 is a representative partially cross-sectional view of another example of the well system and method.

Referring additionally now to FIG. 7, another example of the system 10 is representatively illustrated. In this example, the controller 62, valve 64, actuator 66, switch 74 and battery 76 are not contained in the whipstock 22. Instead, these elements and others are incorporated into an RFID sub 80 that is connected in the drill string 52 above the mill 24.

The FIG. 7 system 10 operates in a manner fundamentally similar to that described above for the FIGS. 1-6 example. Fluid pressure in the flow passage 50 due to flow of the fluid 56 is used to set the anchor 20 (see FIG. 1) and then, when it is desired to release the mill 24 from the whipstock 22, an RFID tag 58 is deployed into the flow passage. However, in the FIG. 7 example, the mill 24 is released in response to the RFID tag 58 being displaced into the RFID sub 80.

Figure 8A:
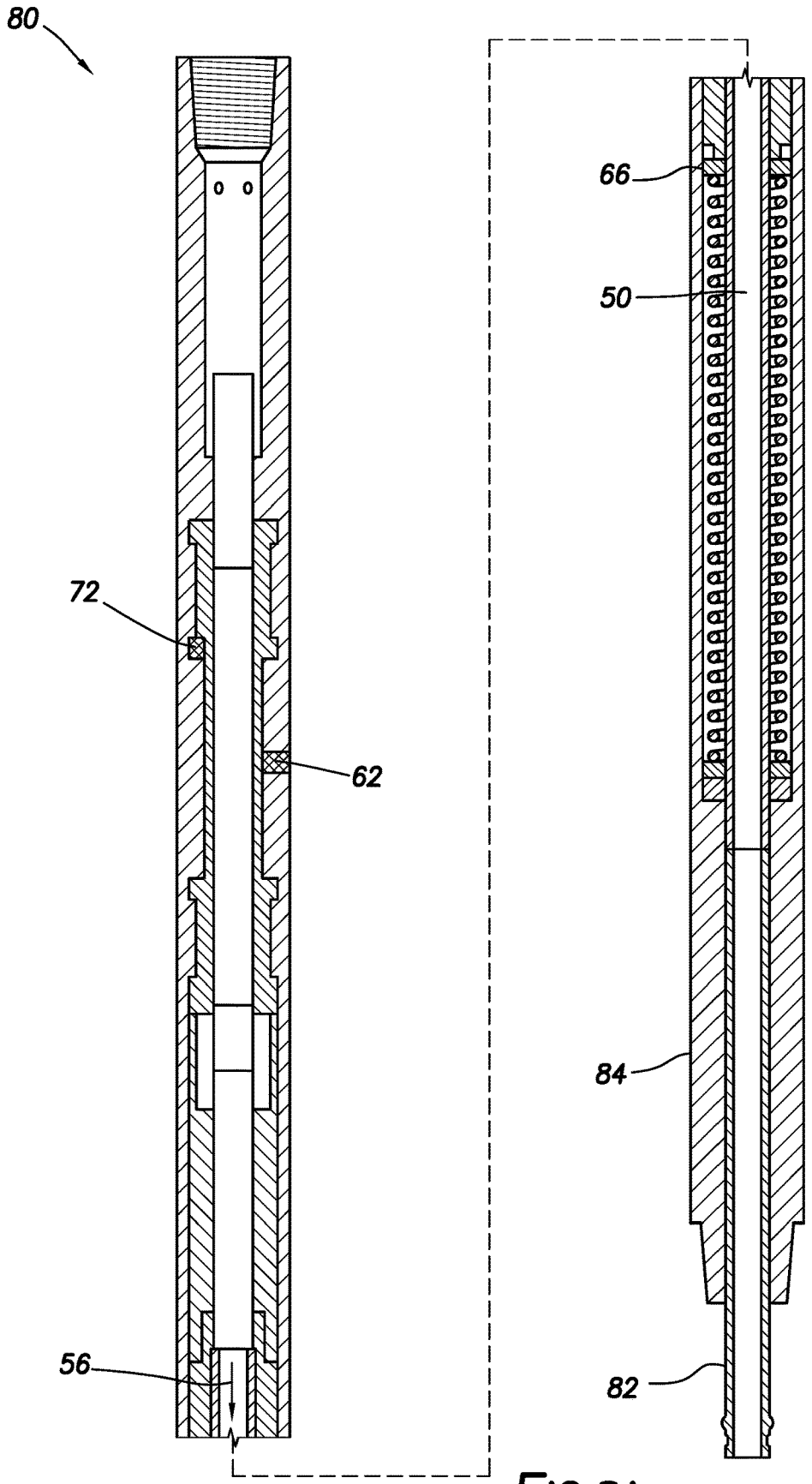
FIGS. 8A & B are representative cross-sectional views of an example of an RFID sub that may be used with the FIG. 7 well system and method.
Figure 8B:
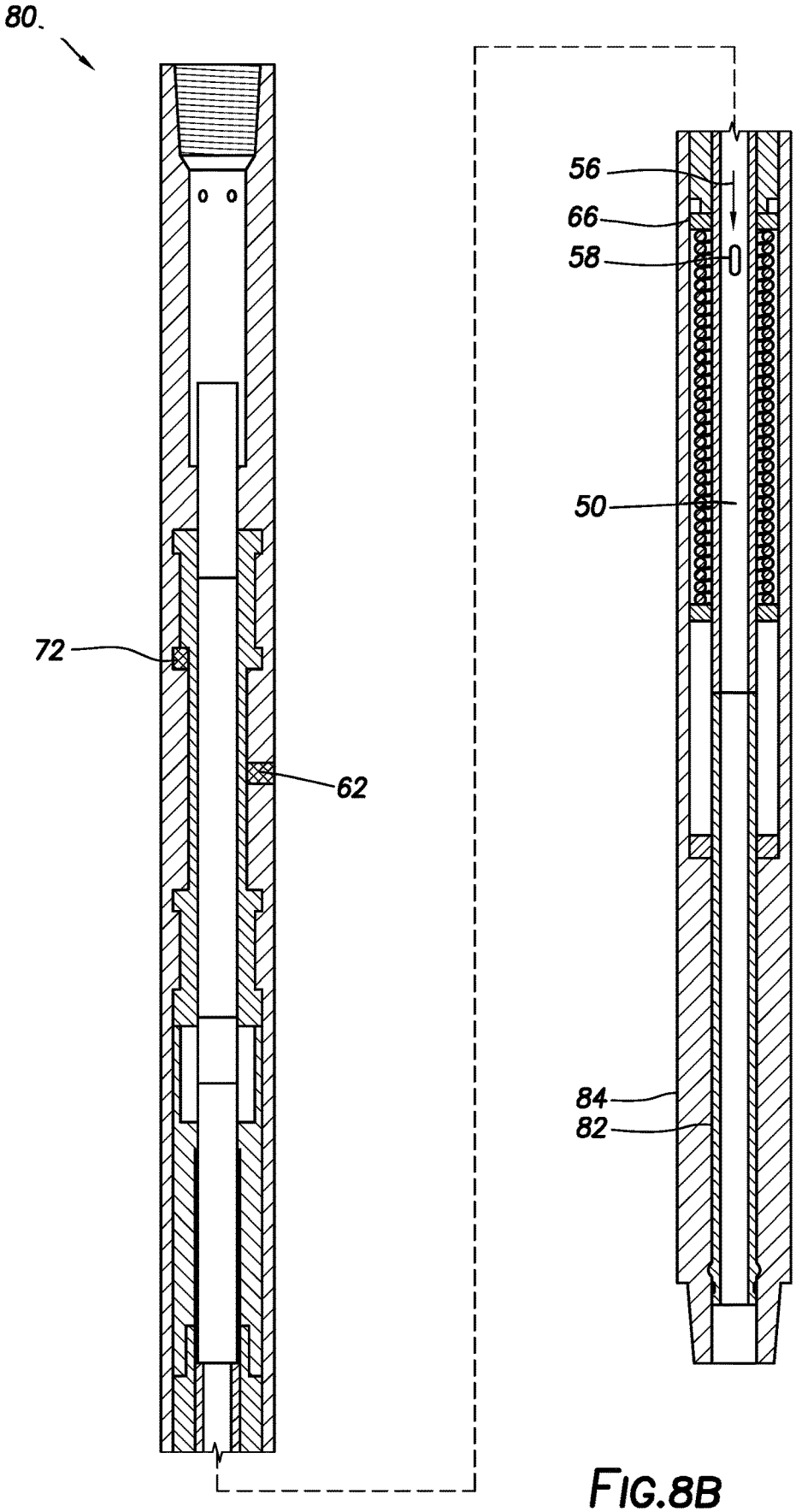

Referring additionally now to FIGS. 8A & B, an example of the RFID sub 80 is representatively illustrated in respective extended and retracted configurations. Note that, in the FIG. 8A extended configuration, a tubular mandrel 82 extends outwardly from an outer housing 84 of the RFID sub 80. In the FIG. 8B retracted configuration, the mandrel 82 is displaced upward into the outer housing 84.

The actuator 66 displaces the mandrel 82 between its extended and retracted positions in response to predetermined radio frequency signals received by the antenna 72 from RFID tags 58 displaced through the flow passage 50. In one example, the actuator 66 may only displace the mandrel 82 from the extended to the retracted position in response to an RFID tag 58 being displaced into the flow passage 50 in the RFID sub 80. In another example, the mandrel 82 may also be displaced from the retracted position to the extended position in response to another RFID tag 58 being displaced into the flow passage 50 in the RFID sub 80.

In the FIGS. 8A & B example, the RFID sub 80 is initially in the extended configuration and is deployed into the well with the remainder of the bottom hole assembly 12. When the whipstock 22 is appropriately positioned in the wellbore 14, the anchor 20 is set by flowing the fluid 56 through the flow passage 50 at or above a predetermined flow rate to thereby cause an increase in fluid pressure in the flow passage. This increased fluid pressure is communicated to the anchor 20 via the tubing 68 as described above.

After the anchor 20 is set and it is desired to release the mill 24 from the whipstock 22, an RFID tag 58 is released into the drill string 52, and the RFID tag is displaced with the fluid 56 flow into the flow passage 50. The predetermined radio frequency signal 78 transmitted by the RFID tag 58 is received by the antenna 72 and, in response, the controller 62 operates the actuator 66. The mandrel 82 is displaced from the FIG. 8A extended position to the FIG. 8B retracted position by the actuator 66.

Figure 9:
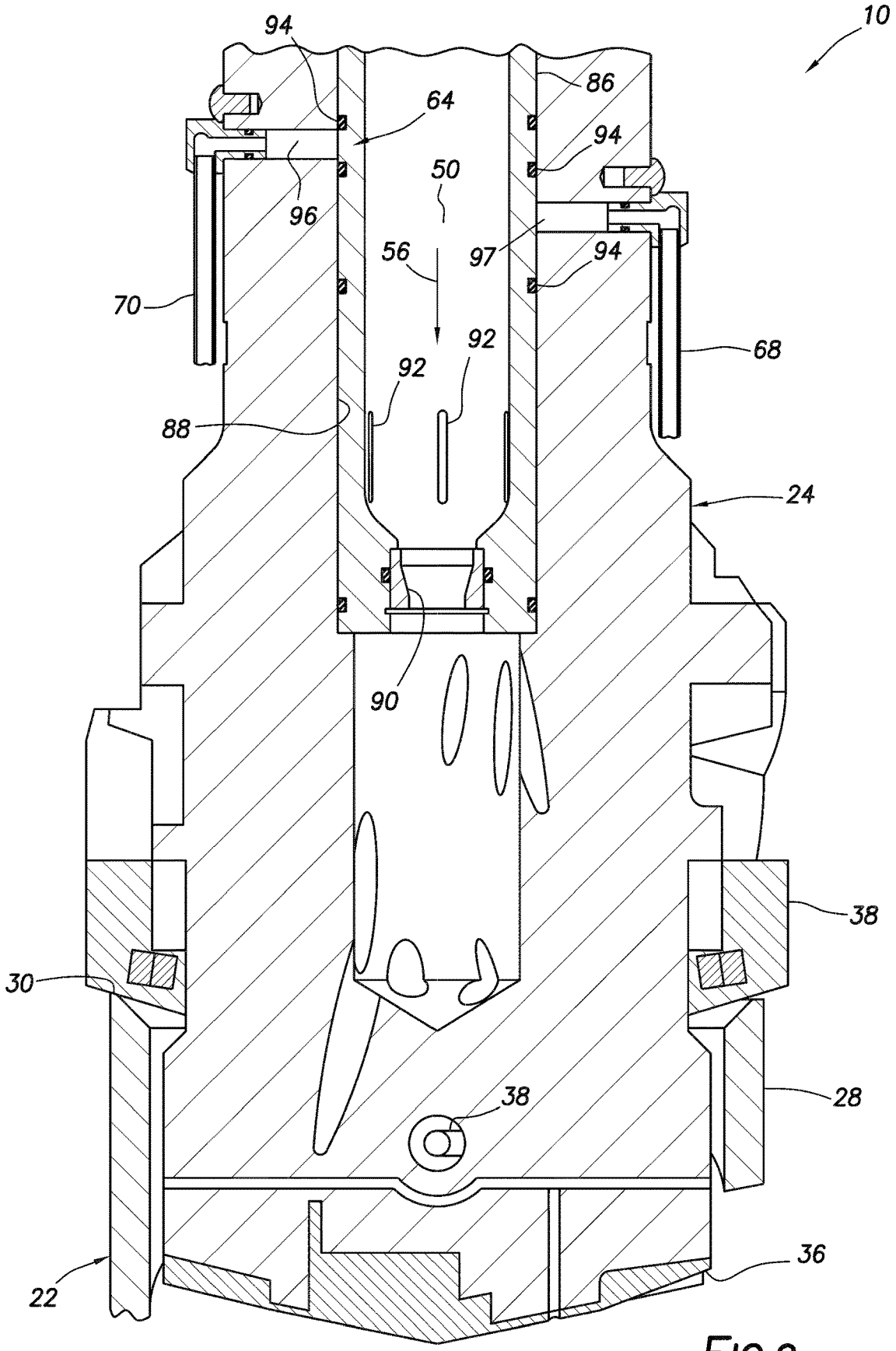
FIG. 9 is a representative cross-sectional view of an example of a valve section of the FIG. 7 well system and method.

Referring additionally now to FIG. 9, a cross-sectional view of an example of the mill 24 and the upper end 30 of the whipstock 22 is representatively illustrated. In this view, a manner in which the displacement of the mandrel 82 may be used to release the mill 24 from the whipstock 22 can be seen.

In the FIG. 9 example, a sleeve 86 is sealingly and reciprocally received in a bore 88 formed in the mill 24. The sleeve 86 may be formed on a lower end of the mandrel 82 (see FIGS. 8A & B), or the sleeve may be a separate component connected to the lower end of the mandrel.

In this example, a flow restriction or nozzle 90 is positioned in a lower end of the sleeve 86 in order to produce an increased fluid pressure in the flow passage 50 due to the flow of the fluid 56. The increased fluid pressure is communicated to the tubing 68 via openings 92 formed through a wall of the sleeve 86. As described above, the tubing 68 communicates the fluid pressure in the flow passage 50 to the anchor 20. A similar nozzle 90 may be used in the FIGS. 1-5 example to increase fluid pressure in the flow passage 50 caused by the flow of the fluid 56.

As depicted in FIG. 9, the fluid pressure in the flow passage 50 is isolated from the flow paths 68, 70 by the valve 64. In this example, the valve 64 comprises an upper section of the sleeve 86 on which seals 94 are carried. In the position of the sleeve 86 shown in FIG. 9, the seals 94 straddle openings 96, 97 formed through a wall of the mill 24.

When the sleeve 86 is displaced somewhat upward, however, the opening 97 and the flow path 68 in communication therewith will be exposed to the fluid pressure in the flow passage 50. When the sleeve 86 is displaced further upward, the opening 96 and the flow path 70 in communication therewith will be exposed to the fluid pressure in the flow passage 50.

The position of the sleeve 86 depicted in FIG. 9 corresponds to the extended position of the mandrel 82 depicted in FIG. 8A. When the mandrel 82 is displaced upward, the sleeve 86 is also displaced upward, thereby placing the flow path 68 in communication with the flow passage 50 and communicating the fluid pressure in the flow passage to the anchor 20 to set the anchor.

When the mandrel 82 is displaced further upward to the retracted position of FIG. 8B, the sleeve 86 is again displaced upward, thereby placing the flow path 70 in communication with the flow passage 50 and communicating the fluid pressure in the flow passage to the pistons 54 of the release mechanism 48. This releases the mill 24 from the whipstock 22 as described above.

Thus, the anchor 20 can be set in response to an RFID tag 58 being displaced into the RFID sub 80, and then the mill 24 can be released from the whipstock 22 in response to another RFID tag 58 being displaced into the RFID sub 80. The predetermined radio frequency signal 78 transmitted by the RFID tag 58 is received by the antenna 72, and in response the controller 62 causes the actuator 66 to displace the mandrel 82 upward. This upward displacement of the mandrel 82 and the sleeve 86 formed thereon or connected thereto opens the valve 64, thereby applying increased fluid pressure first to the anchor 20 and then to the pistons 54 of the release mechanism 48 and releasing the mill 24 from the whipstock 22.

The first RFID tag 58 used to cause setting of the anchor 20 may transmit the same radio frequency signal 78 as the second RFID tag used to cause release of the mill 24 from the whipstock 22. In other examples, the first and second RFID tags 58 may transmit different radio frequency signals 78. Thus, the "set" RFID tag 58 (used to set the anchor 20) transmits a "set" radio frequency signal 78, the subsequent "release" RFID tag 58 (used to release the mill 24 from the whipstock 22) transmits a "release" radio frequency signal 78, and the set and release radio frequency signals may be the same or different.

It may now be fully appreciated that the above disclosure provides significant advancements to the art of designing, constructing and operating mechanisms for releasing mills from whipstocks in wells. In examples described above, the mill 24 can be released from the whipstock 22 by deploying an RFID tag 58 into a flow passage 50 in conjunction with flow of a fluid 56 through the flow passage.

In one example, a bottom hole assembly 12 for use in a subterranean well can comprise a whipstock 22, a mill 24 releasably secured to the whipstock 22, an antenna 72 and a release mechanism 48. The release mechanism 48 is configured to release the mill 24 from the whipstock 22 in response to a predetermined release radio frequency signal 78 received by the antenna 72.

The antenna 72 may be incorporated into the whipstock 22. The antenna 72 may be disposed in an annular section 28 of the whipstock 22 which encircles a portion of the mill 24.

The bottom hole assembly 12 may include a valve 64 and a controller 62. The controller 62 may operate the valve 64 in response to the predetermined release radio frequency signal 78 received by the antenna 72. The valve 64 may selectively open a flow path 70 between a piston 54 of the release mechanism 48 and a flow passage 50 in the mill 24.

The whipstock 22 may include an opening 44, a retractable pin 38 may extend from the mill 24 into the opening 44, and the mill 24 may be releasable from the whipstock 22 in response to retraction of the pin 38 from the opening 44.

The antenna 72 may be configured to receive the predetermined release radio frequency signal 78 in response to displacement of a release radio frequency identification tag 58 into the bottom hole assembly 12.

The bottom hole assembly 12 may include an anchor 20. The anchor 20 may be set in response to a predetermined set radio frequency signal 78 received by the antenna 72.

In another example, a method for use with a subterranean well can include positioning a bottom hole assembly 12 in the well, the bottom hole assembly 12 including a mill 24 and a whipstock 22 releasably secured to the mill 24, and then releasing the mill 24 from the whipstock 22 by displacing a release radio frequency identification tag 58 into the bottom hole assembly 12.

The displacing step may include displacing the release radio frequency identification tag 58 through the mill 24.

The displacing step may include displacing the release radio frequency identification tag 58 through an annular section 28 of the whipstock 22. The annular section 28 may encircle a portion of the mill 24.

The displacing step may include displacing the release radio frequency identification tag 58 through a sub 80, with the mill 24 being connected between the sub 80 and the whipstock 22.

The releasing step may include an actuator 66 of the sub 80 actuating a valve 64 in the mill 24, thereby opening the valve 64 and permitting fluid communication between a flow passage 50 in the mill 24 and a flow path 70 to a piston 54 of a hydraulic release mechanism 48 of the whipstock 22.

The releasing step may include an antenna 72 of the whipstock 22 receiving a predetermined release radio frequency signal 78 from the release radio frequency identification tag 58.

The releasing step may include a controller 62 actuating a valve 64 and thereby opening a flow path 70 between a flow passage 50 in the mill 24 and a piston 54 of a hydraulic release mechanism 48.

The releasing step may include retracting a pin 38 into the mill 24 from an opening 44 in the whipstock 22.

The method may include setting an anchor 20 in response to displacing a set radio frequency identification tag 58 into the bottom hole assembly 12.

In another example, a well system 10 can include a bottom hole assembly 12 comprising an anchor 20, a whipstock 22 and a mill 24; and a release radio frequency identification tag 58 displaceable with fluid 56 flow into the bottom hole assembly 12. The anchor 20 is settable by fluid pressure applied to a flow passage 50 in the mill 24. A hydraulic release mechanism 48 releasably secures the mill 24 to the whipstock 22. A valve 64 is configured to permit fluid communication between the flow passage 50 and a piston 54 of the hydraulic release mechanism 48 in response to a predetermined release radio frequency signal 78 transmitted by the release radio frequency identification tag 58.

The antenna 72 may be incorporated into the whipstock 22. The antenna 72 may be disposed in an annular section 28 of the whipstock 22. The annular section 28 may encircle a portion of the mill 24.

The well system 10 may include a controller 62 configured to operate the valve 64 in response to the predetermined release radio frequency signal 78 transmitted by the radio frequency identification tag 58. The controller 62 may be positioned in the whipstock 22 (as in the FIGS. 1-6 example). The mill 24 may be connected between the whipstock 22 and the controller 62 (as in the FIGS. 7-9 example).

The valve 64 may be configured to permit fluid communication between the flow passage 50 and an anchor 20 in response to a predetermined set radio frequency signal 78 transmitted by a set radio frequency identification tag 58.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A bottom hole assembly for use in a subterranean well, the bottom hole assembly comprising:

a whipstock;

a mill releasably secured to the whipstock;

an antenna;

a release mechanism, in which the release mechanism is configured to release the mill from the whipstock in response to a predetermined release radio frequency signal received by the antenna; and a valve and a controller, in which the controller is configured to operate the valve in response to the predetermined release radio frequency signal received by the antenna, and in which the valve is configured to selectively open a flow path between a piston of the release mechanism and a flow passage in the mill.

2. The bottom hole assembly of claim 1, in which the antenna is incorporated into the whipstock.

3. The bottom hole assembly of claim 2, in which the antenna is disposed in an annular section of the whipstock, and the annular section encircles a portion of the mill.

4. The bottom hole assembly of claim 1, in which the whipstock comprises an opening, a retractable pin extends from the mill into the opening, and the mill is releasable from the whipstock in response to retraction of the pin from the opening.

5. The bottom hole assembly of claim 1, in which the antenna is configured to receive the predetermined release radio frequency signal in response to displacement of a release radio frequency identification tag into the bottom hole assembly.

6. The bottom hole assembly of claim 1, further comprising an anchor, and in which the anchor is set in response to a predetermined set radio frequency signal received by the antenna.

7. A method for use with a subterranean well, the method comprising:

positioning a bottom hole assembly in the well, the bottom hole assembly including a mill and a whipstock releasably secured to the mill; and then releasing the mill from the whipstock by displacing a release radio frequency identification tag into the bottom hole assembly, in which the releasing comprises an antenna of the whipstock receiving a predetermined release radio frequency signal from the release radio frequency identification tag, and in which the releasing further comprises a controller actuating a valve and thereby opening a flow path between a flow passage in the mill and a piston of a hydraulic release mechanism.

8. The method of claim 7, in which the displacing comprises displacing the release radio frequency identification tag through the mill.

9. The method of claim 7, in which the displacing comprises displacing the release radio frequency identification tag through an annular section of the whipstock, and the annular section encircles a portion of the mill.

10. The method of claim 7, in which the displacing comprises displacing the release radio frequency identification tag through a sub, the mill being connected between the sub and the whipstock.

11. The method of claim 10, in which the releasing comprises an actuator of the sub actuating a valve in the mill, thereby opening the valve and permitting fluid communication between a flow passage in the mill and a flow path to a piston of a hydraulic release mechanism of the whipstock.

12. The method of claim 7, in which the releasing comprises retracting a pin into the mill from an opening in the whipstock.

13. The method of claim 7, further comprising setting an anchor in response to displacing a set radio frequency identification tag into the bottom hole assembly.

14. A well system comprising:

a bottom hole assembly comprising an anchor, a whipstock and a mill; and a release radio frequency identification tag displaceable with fluid flow into the bottom hole assembly, in which the anchor is settable by fluid pressure applied to a flow passage in the mill, in which a hydraulic release mechanism releasably secures the mill to the whipstock, and in which a valve is configured to permit fluid communication between the flow passage and a piston of the hydraulic release mechanism in response to a predetermined release radio frequency signal transmitted by the release radio frequency identification tag.

15. The well system of claim 14, in which an antenna is incorporated into the whipstock.

16. The well system of claim 15, in which the antenna is disposed in an annular section of the whipstock, and the annular section encircles a portion of the mill.

17. The well system of claim 14, further comprising a controller configured to operate the valve in response to the predetermined release radio frequency signal transmitted by the release radio frequency identification tag.

18. The well system of claim 17, in which the controller is positioned in the whipstock.

19. The well system of claim 17, in which the mill is connected between the whipstock and the controller.

20. The well system of claim 14, in which the whipstock comprises an opening, a retractable pin extends from the mill into the opening, and the mill is releasable from the whipstock in response to retraction of the pin from the opening.

21. The well system of claim 14, in which the valve is configured to permit fluid communication between the flow passage and an anchor in response to a predetermined set radio frequency signal transmitted by a set radio frequency identification tag.

* * * * *